US005810190A

United States Patent [19]

Welch

[11] Patent Number: 5,810,190

[45] Date of Patent: Sep. 22, 1998

[54] PLASTIC BUNG SEAL

[75] Inventor: William G. Welch, Atlanta, Ga.

[73] Assignee: Atlanta Polyseal Ltd., Marietta, Ga.

[21] Appl. No.: 884,414

[22] Filed: Jun. 27, 1997

[51] Int. Cl.[6] ..... B65D 51/18

[52] U.S. Cl. ..... 220/257; 220/214; 220/780; 215/251; 215/277

[58] Field of Search ..... 220/214, 256, 220/254, 257, 780, 794, 309.1, 361, 363, 601, 661; 215/251, 250, 277, 278, 320, 354

[56] References Cited

U.S. PATENT DOCUMENTS

| | | | |
|---|---|---|---|
| D. 32,916 | 7/1900 | Lindemeyr . | |
| D. 289,143 | 4/1987 | Guillaume . | |
| D. 304,424 | 11/1989 | Dawson . | |
| D. 311,868 | 11/1990 | Armstrong . | |
| D. 316,671 | 5/1991 | Rohmeder . | |
| D. 327,849 | 7/1992 | Armstrong . | |
| D. 365,519 | 12/1995 | Welch et al. . | |
| 1,426,917 | 8/1922 | Scofield . | |
| 1,656,228 | 1/1928 | Parish . | |
| 2,010,535 | 8/1935 | Cooper . | |
| 2,084,007 | 6/1937 | Schwartz . | |
| 2,100,168 | 11/1937 | Melrath | 220/214 X |
| 2,162,753 | 6/1939 | Schauer | 220/257 |
| 2,173,449 | 9/1939 | Kronman . | |
| 2,243,290 | 5/1941 | Schwartz | 220/256 |
| 2,343,286 | 3/1944 | Dodson . | |
| 2,760,671 | 8/1956 | Parish, Jr. . | |
| 3,019,933 | 2/1962 | Gould et al. . | |
| 3,122,261 | 2/1964 | Parish, Jr. et al. . | |
| 3,604,582 | 9/1971 | Boudin . | |
| 3,811,597 | 5/1974 | Frankenberg et al. . | |
| 3,919,901 | 11/1975 | Braman . | |
| 3,923,192 | 12/1975 | Walters . | |
| 3,942,679 | 3/1976 | Starr . | |
| 3,987,929 | 10/1976 | Mineo . | |
| 4,164,304 | 8/1979 | Roberson | 220/214 X |
| 4,211,333 | 7/1980 | Villarejos . | |
| 4,355,742 | 10/1982 | Scholle . | |
| 4,607,759 | 8/1986 | Boetzkes . | |
| 4,700,860 | 10/1987 | Li . | |
| 4,706,836 | 11/1987 | Greck . | |
| 4,844,268 | 7/1989 | Bullock, III | 215/256 |
| 5,050,754 | 9/1991 | Marino | 215/256 |
| 5,096,077 | 3/1992 | Odet et al. . | |
| 5,232,120 | 8/1993 | Dunken et al. . | |

FOREIGN PATENT DOCUMENTS

| | | | |
|---|---|---|---|
| 2252262 | 6/1975 | France | 215/251 |
| 501793 | 3/1953 | Italy | 220/257 |

OTHER PUBLICATIONS

Injection Molded Cap by Kerr, photo top right corner of p. 36, *Drug & Cosmetic Industry Magazine,* Jun. 1985.

*Primary Examiner*—Allan N. Shoap
*Assistant Examiner*—Nathan Newhouse
*Attorney, Agent, or Firm*—Howson and Howson

[57] ABSTRACT

A plastic bung seal forming two separate seals with the plug and collar of a receptacle. The bung seal allows ready detection of unauthorized access to the contents of the receptacle, since the double seal prevents its removal without visually perceptible destruction of the bung seal.

7 Claims, 2 Drawing Sheets

PLASTIC BUNG SEAL

BRIEF SUMMARY OF THE INVENTION

The invention relates to bung seals, also called cap seals, for protection of closure fitments and closure plugs on barrels, tanks and other fluid containers. It relates more particularly to a plastic bung seal which is especially difficult to pry off a closure fitment or plug of a fluid container, so that unauthorized access to the fluid container can be detected.

As disclosed in U.S. Pat. Nos. 2,084,007 and 2,010,535, access to fluid inside of a tank is provided by an opening formed in a wall of the tank by a permanently attached threaded fitment or bushing. A threaded plug engages the fitment to seal the opening.

Since it is desirable to prevent unauthorized access through the opening, a bung seal is used to cover, and prevent access to, the fitment and plug. The bung seal is designed so that its unauthorized removal is readily detectable. The above-referenced patents disclose bung seals made of tin, which are crimped to the fitment and plug. U.S. Pat. Nos. 1,656,228, 2,343,286, and 2,760,671 also disclose crimped tin bung seals.

U.S. Pat. Nos. 3,122,261, 3,923,192, 3,987,929 and 4,706,836 disclose bung seals manufactured of plastic, which snap fit over the fitment and plug. A problem with plastic bung seals is that they do not always create a sufficiently tight seal, and can be removed and re-attached without detection.

Therefore, the general object of this invention is to provide a plastic bung seal which is readily installed on a closure fitment and plug, but difficult to remove and replace without its removal being visually detectable. An important specific object of the invention is to provide an improved plastic bung seal with a double grab feature such that the bung seal engages both the fitment and the plug to resist its removal.

The invention addresses the foregoing objects by providing an improved plastic bung seal for inhibiting undetectable access to a plug engaged with an opening of a receptacle. The opening is defined by an annular collar which projects out of a wall of the receptacle and which has an outwardly extending annular bead spaced from the wall of the receptacle. The plug engages the collar and has an outwardly extending flange which extends above a portion of the collar.

The bung seal in accordance with the invention has a top wall with an annular skirt. The top wall is flat and is positioned over the plug to prevent access to the plug. The annular skirt has a stepped cross-section and consists of an upper annular portion having a first diameter, a larger diameter lower annular portion, and a radially extending intermediate wall spaced from the top wall and connecting the bottom of the upper annular portion to the top of the lower annular portion. The upper annular portion of the skirt extends from the top wall to the annular collar defining the opening of the receptacle. The lower annular portion of the skirt extends from the intermediate wall of the skirt to the wall of the receptacle surrounding the collar.

The bung seal is formed with an upper bead which extends inwardly from the upper annular portion of the skirt at a location spaced axially from the top wall. The upper bead of the skirt has an inner diameter smaller than the outer diameter of the flange of the plug. However, it is sufficiently flexible and resilient that, when placed over the flange of the plug, it can be moved past the flange and captured beneath the flange.

A lower bead extends inwardly from the lower annular portion of the skirt at a location below and spaced axially from the intermediate wall of the skirt. The lower bead has an inner diameter smaller than that of the bead of the collar, but is sufficiently flexible and resilient that it can be placed over and moved past the bead of the collar so that the lower bead is captured beneath the bead of the collar.

DETAILED DESCRIPTION

Figure 1:
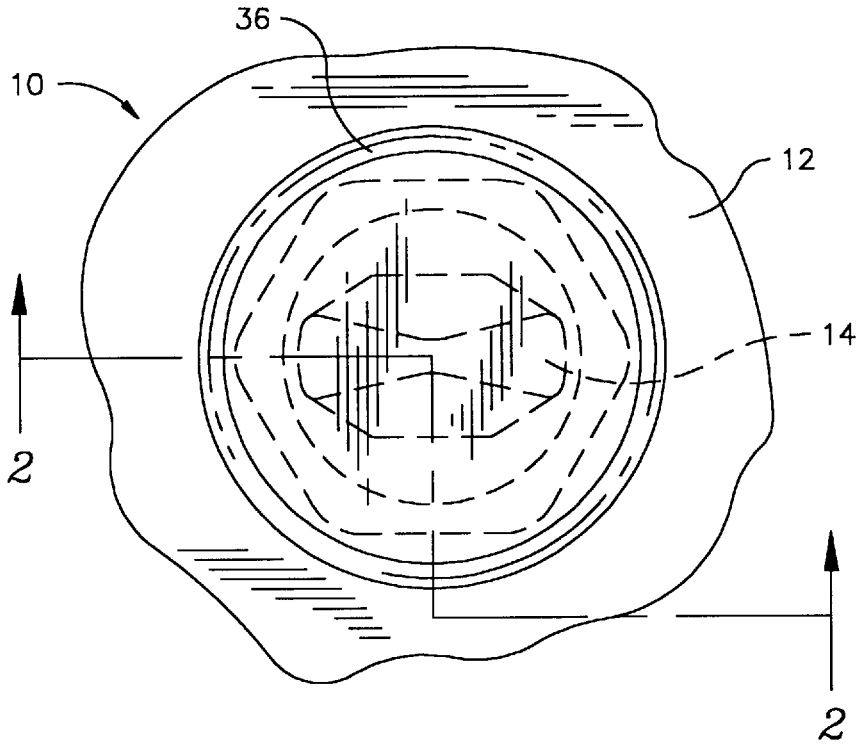
FIG. 1 is a plan view of a portion of a receptacle having a port which is covered by a bung seal embodying the invention.

FIG. 1 illustrates a closed port in a wall 12 of a receptacle 10. The port allows access to the liquid contained in the receptacle 10.

Figure 2:
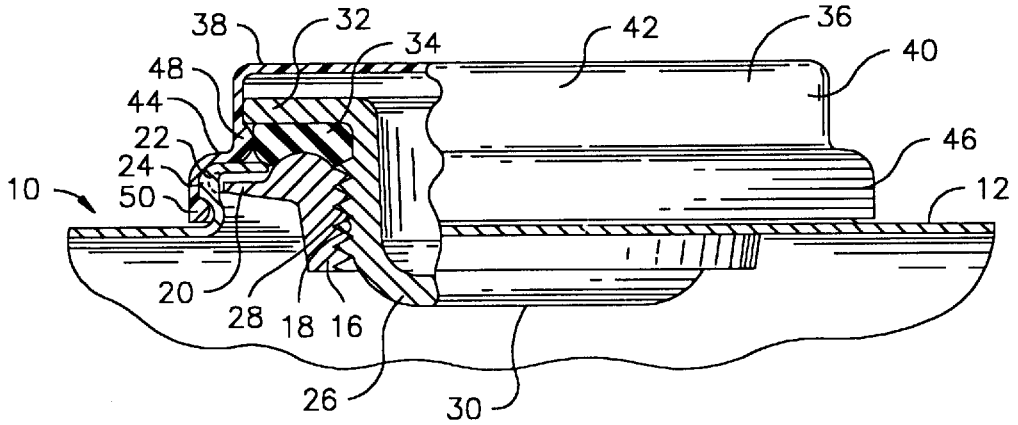
FIG. 2 is a cross-sectional view of the receptacle taken on surface 2—2 of FIG. 1.
Figure 3:
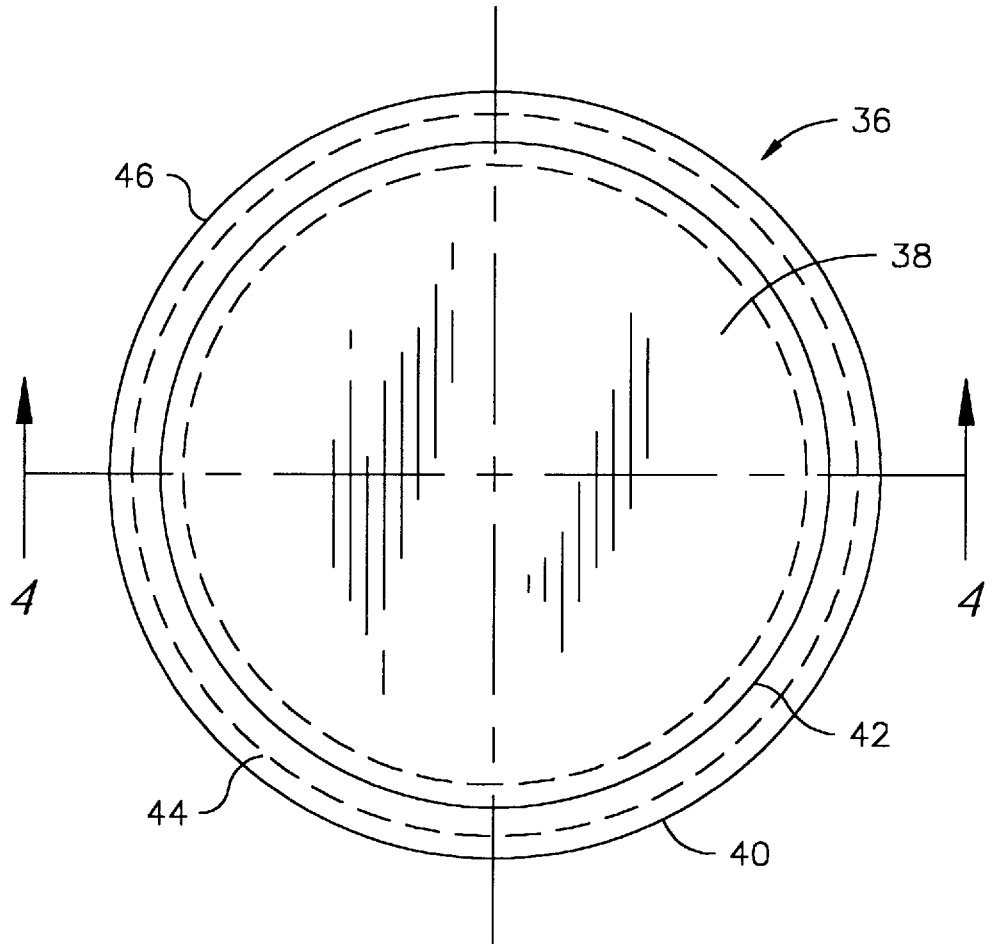
FIG. 3 is a plan view of the bung seal.
Figure 4:
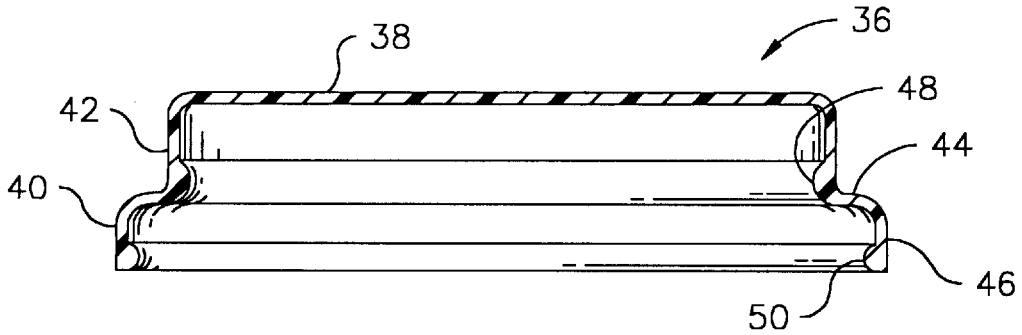
FIG. 4 is a cross-sectional view of the bung seal taken on plane 4—4 of FIG. 3.

As illustrated in FIG. 2, the port is defined by a fitment 16 which is permanently attached to the wall 12. The fitment 16 has a threaded inner wall 18 and an outwardly extending flange 20. The outwardly extending flange 20 is captured in a groove formed on the interior side of an upstanding collar 22, which is formed by bending part of wall 12. The formation of the groove on the interior side of the collar also produces an outwardly extending bead 24 at a location spaced from the part of wall 12 surrounding the collar 22.

A plug 26 is received within the fitment 16 to seal the port. The plug 26 has threads 28 which engage with the threads of the inner wall 18 of the fitment 16. As illustrated by dashed lines in FIG. 1, the plug 26 has a recessed handle 14 which can be manipulated to rotate the plug and engage and disengage the threads. One end of the plug 26 is closed by an end-wall 30, and the other end has an outwardly extending flange 32. A gasket 34 is located under the flange 32 to create a tight seal between the plug and fitment 16 when the plug is tightened. As shown in FIG. 2, both the flange 32 and the gasket 34 are located above the collar 22, but do not extend radially beyond collar 22.

A bung seal 36 is used to cover the plug 26 and fitment 16 on the exterior side of the receptacle 10. The bung seal 36 is preferably made of polyethylene or a similar relatively stiff, but flexible and resilient plastics material having a flexibility limit such that flexure beyond that limit results in permanent and visible distortion or tearing of the material. The bung seal is specifically designed to be readily affixed to the plug 26 and collar 22, but to resist removal therefrom. Removal of the bung seal 36 from the receptacle 10, requires permanent distortion such that visual inspection of the bung seal 36 will indicate whether or not it has ever been removed. Thus, unauthorized access to the opening of the receptacle can be detected by visual inspection of the bung seal 36, even if the bung seal is re-attached to the receptacle. The limit in the flexibility of the bung seal material is determined both by its composition and by its thickness, and the appropriate flexibility limits and characteristics can be readily achieved by molding the bung seal in the appropriate thickness.

The bung seal 36 has a flat top wall 38 and an integral annular skirt 40 having a stepped cross-section. As shown in FIG. 1, the top wall 38 extends across and covers the plug 26. Thus, it prevents access to and removal of the plug 26. The annular skirt 40 extends from the peripheral edge of the top wall 38 to the wall 12 of the receptacle 10 surrounding the collar 22.

The annular skirt 40 is has an upper annular portion 42, a radially extending intermediate wall 44, and a lower annular portion 46. The upper annular portion 42 extends from the top wall 38 to the intermediate wall 44 and is smaller in diameter than the lower annular portion 46. The lower annular portion 46 of the skirt extends from the outer peripheral edge of the intermediate wall 44. When the bung seal 36 is secured to the receptacle 10 over the plug 26, opening 14, fitment 16 and collar 22, the upper annular portion 42 of the skirt extends along the outer edge of flange 32 of the plug 26, and along gasket 34, to the top of the collar 22. The intermediate wall 44 of the skirt 40 lies adjacent to the top of the collar 22, and the lower annular portion 46 extends along the side of the collar 22 to a location adjacent to the wall 12.

An important aspect of the invention is the use of dual sealing beads, 48 and 50, on the bung seal 36 so that two separate areas of sealing engagement are provided, one with the plug 26, and the other with collar 22. To this end, the upper sealing bead 48 is formed on the inside of the upper annular portion 42 of the skirt 40 at a location spaced from the top wall 38. The internal diameter of the upper sealing bead 48 is smaller than the outer diameter of the plug flange 32, but the upper bead 48 is sufficiently flexible and resilient that it snaps over and past the flange 32. Once the upper sealing bead 48 is located beneath the flange 32 it is captured below the flange and is in sealing engagement with the plug 26.

Likewise, a lower sealing bead 50 is formed on the lower annular portion 46 of the skirt 40 at a location spaced from the intermediate wall 44 of the skirt. The lower sealing bead 50 has a smaller diameter than that of the outwardly extending bead 24 of the collar 22, but is sufficiently flexible and resilient to snap over and past the bead 24 of the collar 22. Once the lower sealing bead 50 is located beneath the bead 24, it is captured below bead 24, and engages the collar 22, forming a seal.

The engagement of bead 48 underneath plug flange 32, and the engagement of bead 50 underneath collar bead 24, produces a dual locking engagement of the bung seal 36 with the receptacle opening. If an attempt is made to pry the bung seal in such a way as to release the lower bead from the collar of the opening, the upper bead will tend to remain in engagement with the flange of the plug. The more severe prying action required to disengage both of the upper and lower beads of the bung seal simultaneously distorts the bung seal beyond its limit of flexibility and results in a permanent and visible distortion or tearing of the bung seal. Thus, the dual locking engagement increases the difficulty of removal of the bung seal 36 from the receptacle without destroying it and unauthorized removal of the bung seal is readily detected.

Various modifications can be made to the bung seal described above without departing from the scope of the invention as defined in the following claims.

What I claim is:

1. A plastic bung seal for inhibiting undetectable access to a plug engageable with a collar of an opening of a receptacle, comprising:

a top wall for placement over the plug to prevent access thereto;

a unitary annular skirt extending from the top wall and having a stepped cross-section formed by an annular upper portion, an intermediate wall and an annular lower portion;

an upper bead extending radially inwardly from the upper portion of the skirt and being spaced axially from the top wall and sufficiently flexible and resilient that it can be moved past, and captured beneath, a flange of the plug; and a lower bead extending radially inwardly from the lower portion of the skirt and being spaced axially from the intermediate wall and sufficiently flexible and resilient that it can be moved past, and captured beneath, a radially outwardly projecting bead of the collar into which the plug fits.

2. A plastic bung seal according to claim 1 in which the annular upper and lower portions of the skirt are connected by a radially extending intermediate wall, and the annular upper portion has a smaller diameter than the annular lower portion.

3. A plastic bung seal according to claim 1 in which the upper bead has a diameter smaller than that of the lower bead.

4. A plastic bung seal according to claim 1 in which the top wall, the skirt and the upper and lower beads are a molded unit.

5. A plastic bung seal according to claim 1 in which the limit of the flexibility of the bung seal is such that when a sufficient prying force is applied to lower bead to cause the upper bead to be released from the flange of a plug underneath which the upper bead is captured, the bung seal is permanently and visibly distorted.

6. A plastic bung seal for inhibiting undetectable access to a plug engageable with an opening of a receptacle, the opening being defined by an annular collar projecting along an axis outwardly from a wall of the receptacle surrounding the collar, the collar having an annular bead spaced from the wall of the receptacle and extending radially outward from said axis, and the plug being sealingly engageable with the collar and having a flange which also extends radially outward from said axis and is located above a portion of the collar, the bung seal comprising:

a top wall for placement over the plug to prevent access thereto;

a unitary annular skirt extending from said top wall and having a stepped cross-section formed by an annular upper portion connected to an annular lower portion by a radially extending intermediate wall, the upper portion having a smaller diameter than the lower portion and extending from the top wall to the collar, the lower portion extending from the intermediate wall to the wall of the receptacle surrounding the collar;

an upper bead extending radially inwardly from the upper portion of the skirt and being spaced axially from the top wall, the upper bead having a smaller diameter than the flange of the plug and being sufficiently flexible and resilient that it can be moved past, and captured beneath, the flange of the plug; and a lower bead extending radially inwardly from the lower portion of the skirt and being spaced axially from the intermediate wall, the lower bead having a smaller diameter than the annular bead of the collar and being sufficiently flexible and resilient that it can be moved past, and captured beneath, the bead of the collar.

7. In combination with a receptacle having an opening defined by an annular collar projecting along an axis outwardly from a wall of the receptacle surrounding the collar, the collar having an annular bead spaced from the wall of the receptacle and extending radially outward from said axis, and the plug being sealingly engageable with the collar and having a flange which also extends radially outward from said axis and is located above a portion of the collar, a plastic bung seal for inhibiting undetectable access to the plug comprising:

a top wall for placement over the plug to prevent access thereto;

a unitary annular skirt extending from said top wall and having a stepped cross-section formed by an annular upper portion connected to an annular lower portion by a radially extending intermediate wall, the upper portion having a smaller diameter than the lower portion and extending from the top wall to the collar, the lower portion extending from the intermediate wall to the wall of the receptacle surrounding the collar;

an upper bead extending radially inwardly from the upper portion of the skirt and being spaced axially from the top wall, the upper bead having a smaller diameter than the flange of the plug and being sufficiently flexible and resilient that it can be moved past, and captured beneath, the flange of the plug; and a lower bead extending radially inwardly from the lower portion of the skirt and being spaced axially from the intermediate wall, the lower bead having a smaller diameter than the annular bead of the collar and being sufficiently flexible and resilient that it can be moved past, and captured beneath, the bead of the collar.

* * * * *